US005198615A

United States Patent [19]

Robbie et al.

[11] Patent Number: 5,198,615

[45] Date of Patent: Mar. 30, 1993

[54] FUZING SYSTEM FOR TANDEM DEMOLITION WARHEADS

[75] Inventors: Scott W. Robbie, Brooklyn Center; William O. Maruska, Minnetonka, both of Minn.

[73] Assignee: Alliant Techsystems Inc., Minneapolis, Minn.

[21] Appl. No.: 856,531

[22] Filed: Mar. 24, 1992

[51] Int. Cl.[5] ..... F42B 12/16; F42C 15/34; F42C 15/20

[52] U.S. Cl. ..... 102/476; 102/254; 102/260; 102/308; 102/255

[58] Field of Search ..... 102/254, 255, 257, 258, 102/260, 261, 276, 306, 308, 310, 476, 489, 499, 500

[56] References Cited

U.S. PATENT DOCUMENTS

| | | | |
|---|---|---|---|
| 2,946,283 | 7/1960 | Udry | 102/308 |
| 3,439,617 | 4/1969 | Boyd et al. | 102/254 |
| 4,063,512 | 12/1977 | Davis | 102/476 |
| 4,803,928 | 2/1989 | Kramer | 102/476 |
| 4,967,666 | 11/1992 | Kellner et al. . | |

FOREIGN PATENT DOCUMENTS

| | | | |
|---|---|---|---|
| 3341649 | 9/1989 | Fed. Rep. of Germany | 102/476 |
| 2581176 | 10/1986 | France | 102/254 |

*Primary Examiner*—Harold J. Tudor

*Attorney, Agent, or Firm*—Merchant, Gould, Smith, Edell, Welter & Schmidt

[57] ABSTRACT

A fuzing system for use in operating tandem demolition warheads to sequentially activate a propellant on the rear of a follow through charge, detonate a forward shaped charge and detonate the follow through charge after a brief delay. An interface charge is located proximate to blasting caps. A first fuze responsive to the interface charge is configured to ignite the propellant and to arm the first arming assembly. A second fuze responsive to the interface charge is configured to arm the second arming assembly. A first arming assembly containing a first firing pin is located proximate to the follow through charge. A delay fuze is interposed between the first primary charge and the follow through charge. A second arming assembly containing a second firing pin is located proximate to the forward-shaped charge. In the armed state, a primary explosives are interposed between the firing pins and the follow through charge and forward shaped charge. The ignited propellant accelerates the follow through charge into the second firing pin, detonating the forward-shaped charge and forming a hole in the structure to be demolished. The shock wave from the detonation of the foward-shaped charge decelerates the follow through charge, causing the first firing pin to impact the first primary explosive, activating a delay fuze. The delay fuze provides sufficient time for the follow through charge to enter the opening in the structure formed by the forward-shaped charge prior to detonation.

20 Claims, 5 Drawing Sheets

FUZING SYSTEM FOR TANDEM DEMOLITION WARHEADS

This invention was made with Government support Department of the Army. The Government has certain rights in the invention.

BACKGROUND OF THE INVENTION

The present invention relates to a fuzing system for use with tandem demolition warheads, and more particularly, a fuzing system to sequentially activate a propellant on the rear section of a follow through charge, detonate a forward-shaped charge located between the follow through charge and the structure to be demolished, and detonate the follow through charge after a brief delay.

The demolition of reinforced structures, in particular steel reinforced concrete, is often best accomplished if the explosives are embedded within the structure, for example, as disclosed in U.S. Pat. No. 4,967,666 issued on Nov. 6, 1990 to Kellner et al. The penetrated augmented munitions discussed below is specifically designed with a forward-shaped charge for creating an opening in the structure to be demolished into which a follow through charge is propelled. After a brief delay, the follow through charge detonates inside the structure to be demolished.

Military procurement specifications require that all explosives meet certain standards with regard to safety and arming. These standards include resilience of the munitions to shock loads, multiple independent arming steps to prevent inadvertent detonation, and spatial separation of primary explosives from secondary explosives. Primary explosives tend to be extremely unstable, and are therefore useful for triggering larger, more stable secondary explosives.

The fuzing system of the present invention requires manual insertion of the blast initiator or blasting caps followed by two sequential manual arming operations. The blasting caps initiate detonation of an explosive train which ignites the propulsion system on the follow through charge and activates the arming assembly on both the follow through charge and forward shaped charge. The follow through charge collides with the forward-shaped charge, causing its detonation. A delay detonator in the follow through charge is initiated by the blast wave from the forward-shaped charge, allowing the follow through charge to be propelled into the opening created by the forward-shaped charge prior to detonation.

SUMMARY OF THE INVENTION

The present invention relates to a method and apparatus for operating tandem demolition warheads. An interface charge is located proximate to the blasting caps. A first arming assembly containing a first firing pin is located proximate to the follow through charge. In the armed state, a first primary explosive is interposed between the first firing pin and the follow through charge. A delay fuze is interposed between the first primary charge and the follow through charge. A second arming assembly containing a second firing pin is located proximate to the forward-shaped charge. Again, in the armed state a second primary explosive is interposed between the second firing pin and the forward-shaped charge. A first fuze responsive to the interface charge is con-figured to ignite the propellant and to arm the first arming assembly. A second fuze responsive to the interface charge is configured to arm the second arming assembly. The ignited propellant accelerates the follow through charge into the second firing pin on the forward-shaped charge. The detonation of the forward-shaped charge forms a hole in the structure to be demolished. The shock wave from the detonation of the forward-shaped charge decelerates the follow through charge, causing the first firing pin on the first arming assembly to impact the first primary explosive, activating a delay fuze. The delay fuze provides sufficient time for the follow through charge to enter the opening in the structure formed by the forward-shaped charge prior to detonation.

DETAILED DESCRIPTION OF THE PREFERRED EMBODIMENT

Figure 1:
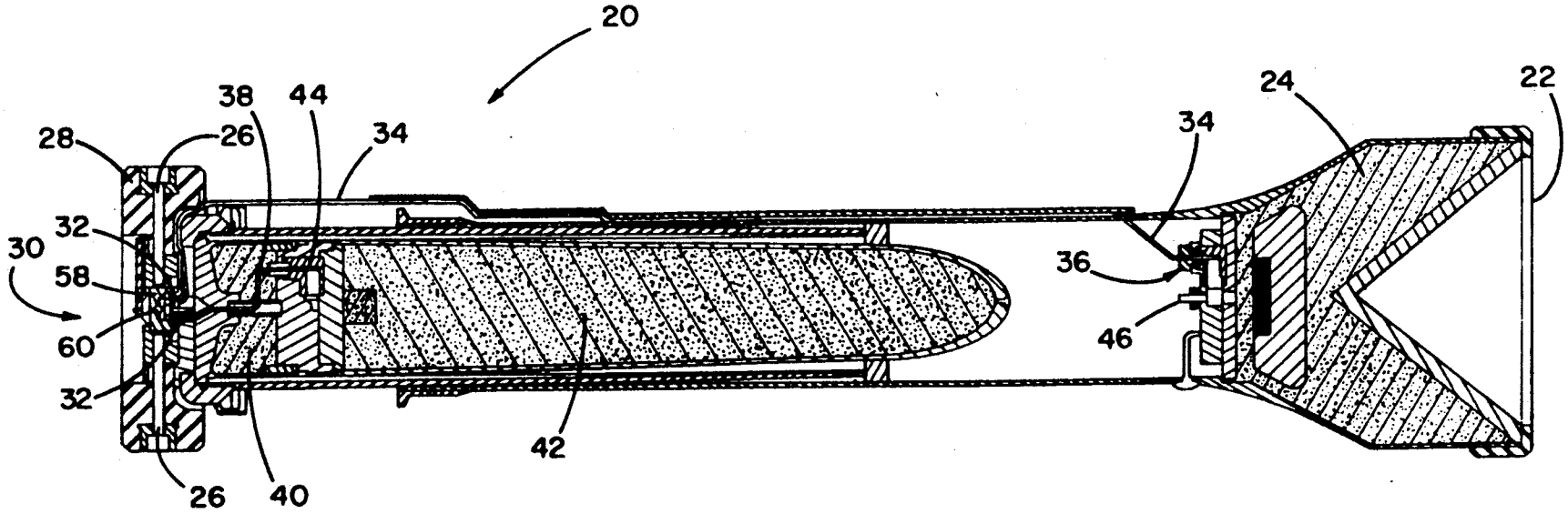
FIG. 1 is a sectional side view of a penetration augmented munition for illustrating a preferred embodiment of the fuzing system of the present invention.

5 FIG. 1 illustrates one possible configuration of a tandem demolition warhead or penetration augmented munition ("PAM") 20 for use with the fuzing system of the present invention. A front surface 22 of the forward-shaped charge ("FSC") 24 is positioned against the structure to be demolished (not shown). On the rearward side of the PAM 20 are two blasting cap wells 26 for receiving blasting caps (not shown). Redundant blasting caps may be provided to insure detonation of the PAM 20.

The blasting cap wells 26 are designed to receive standard demolition initiators, such as M6 electric blasting caps, M7 non-electric blasting caps, detonating cord, standard firing devices, and XM147 time delay firing devices ("TDFD"). It will be understood by those skilled in the art that any suitable blasting cap or other initiator can be used with the fuzing system of the present invention.

A rubberized bumper 28 surrounds the blasting cap wells 26 to shield it from shock and vibration. A cover (not shown) may be inserted into the top of the blasting cap well 26 for securing the blasting cap to the PAM 20.

Figure 3:
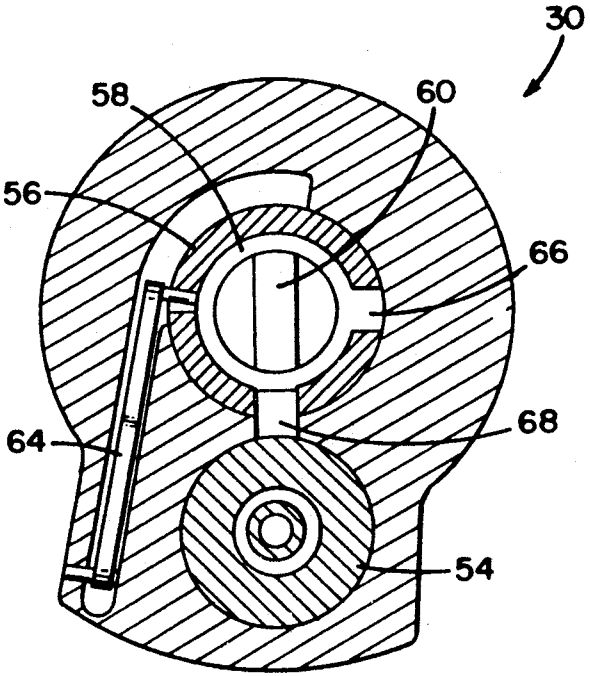
FIG. 3 is a sectional view of a preferred manual arming adaptor.
Figure 2:
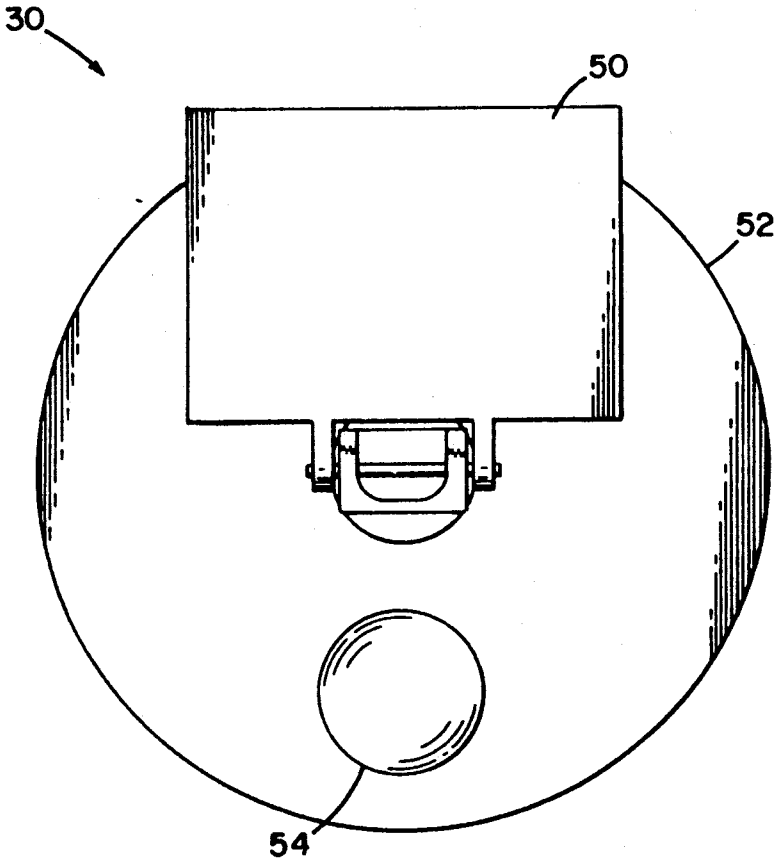
FIG. 2 is an end view of a preferred manual arming adaptor.

A manual arming adapter 30, which will be discussed in more detail in relation to FIGS. 2 and 3, is located proximate to the blasting cap wells 26. Two input interface charges 32 are located proximate to the manual arming adapter 30. The input interface charges 32 are discussed in more detail below.

A first mild detonating fuze explosive 34 ("MDF"), such as a low output explosive cord, extends along the perimeter of the PAM 20 to a forward-shaped charge arming assembly 36. A second mild detonating fuze explosive 38 ("MDF") extends past the propellant 40 on the rear of a follow through charge 42 ("FTC") and continues forward to a follow through charge arming assembly 44. The standards and specifications for the preferred MDF explosive cord of the present invention are set forth in DOD-STD-00100D, ANSI Y14.5M-1982, and MIL-A-2550, which are hereby incorporated by reference.

A FSC firing pin 46 is located on the rearward side of the forward-shaped charge 24. As will be discussed in more detail below, the propellant 40 advances the follow through charge 42 until it collides with the FSC firing pin 46 on the rearward side of the forward-shaped charge 24. The resulting blast from the forward-shaped charge 24 simultaneously creates an opening in the structure to be demolished (not shown) and activates a delay fuze, discussed below, on the follow through charge 42.

FIGS. 2 and 3 illustrate aspects of a preferred manual arming adapter 30 in greater detail. A turning tab 50 is folded against a cover plate 52. The operator folds the turning tab 50 upward until it is perpendicular with the manual arming adapter 30. A spring-loaded release button 54 is provided to lock a rotor 56, shown in FIG. 3, in the safe position.

The turning tab 50 is connected to the rotor 56, illustrated in FIG. 3. The rotor 56 comprises a modified lead cup 58 which contains an explosive 60. PBNX-5 explosive is suitable for this purpose. The modified lead cup 58 is constructed so that the explosive 60 is shielded from the blasting cap wells 26 when in the safe position. FIG. 3 illustrates the arming adaptor 30 in the safe position. If the blasting caps detonate prematurely, the shielding provided by the modified lead cup 58 will prevent the explosives 60 from being detonated. In the armed position, the modified lead cup 58 is turned 90 degrees so that the explosives 60 are in-line with the blasting caps. FIG. 1 illustrates a side view of the explosives 60 shielded from the blasting cap wells 26 by the modified lead cup 58. Rotation of the modified lead cup 58 by 90 degrees interposes the explosive 60 between the wells 26.

An elastic band 64 is provided to return the rotor 56 to the safe position automatically if the operator releases the turning tab 50 before a space 66 is engaged by a flange 68 on the release button 54. The operator can disarm the arming adaptor 30 by pressing the release button 54, which allows the elastic band 64 to return the rotor 56 to the safe position.

As discussed above, the fuzing system of the present invention requires two manual arming actions by the operator. The first manual arming action consists of depressing the release button 54 so that the rotor 56 can be freely turned. The second manual arming action consists of rotating the rotor 56 to the armed condition, whereby the flange 68 engages with the space 66. If after arming the operator decides to disarm the PAM, he or she may do so by merely pressing the release button 54, as discussed above.

Figure 4:
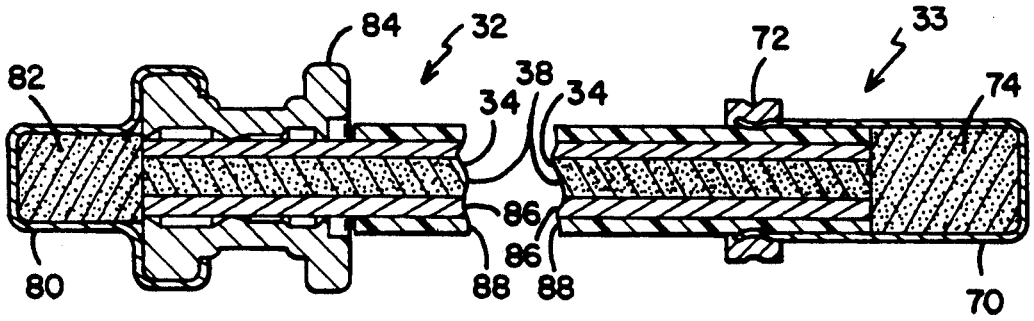
FIG. 4 is a sectional view of the preferred mild detonating fuze input and output interface charges.

FIG. 4 illustrates the input interface charges 32 and output interface charge 33 of a preferred embodiment of the present invention. The input interface charge 32 has a cup 80 containing explosives 82 which is attached to the mild detonating fuze explosive 34,38 by a ferrule 84. HNS explosives are suitable for this purpose, as described in MIL-STD-1316C, which is hereby incorporated by reference. The mild detonating fuze explosives 34,38 of the present invention may be wrapped with an aluminum coating 86 and sealed in plastic 88. The input interface charge 32 is preferably used in connection with the manual arming adaptor 30, illustrated in FIG. 1.

The output interface charge 33 has a cup 70 containing output explosive 74 which is attached to the mild detonating fuze explosive 34, 38 by a collar 72. 19 milligrams of PBXN-5 explosives is suitable as an output explosive. The output interface charge is preferably used to activate the FSC arming assembly (not shown) and the FTC arming assembly 44. Further, the interface charges 32 and 33 may also operate as an explosive train.

Figure 5:
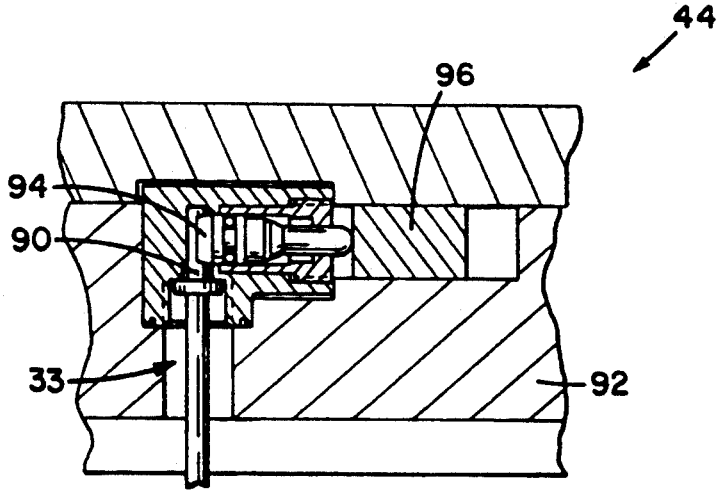
FIG. 5 is a sectional view of a preferred embodiment of an arming piston in the follow through charge arming assembly.
Figure 8:
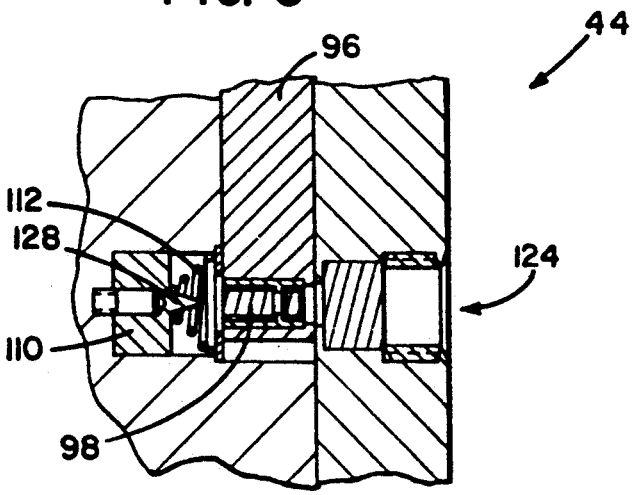
FIG. 8 is a sectional view of a preferred primary explosives in alignment with the FTC firing pin in the follow through charge arming assembly.
Figure 6:
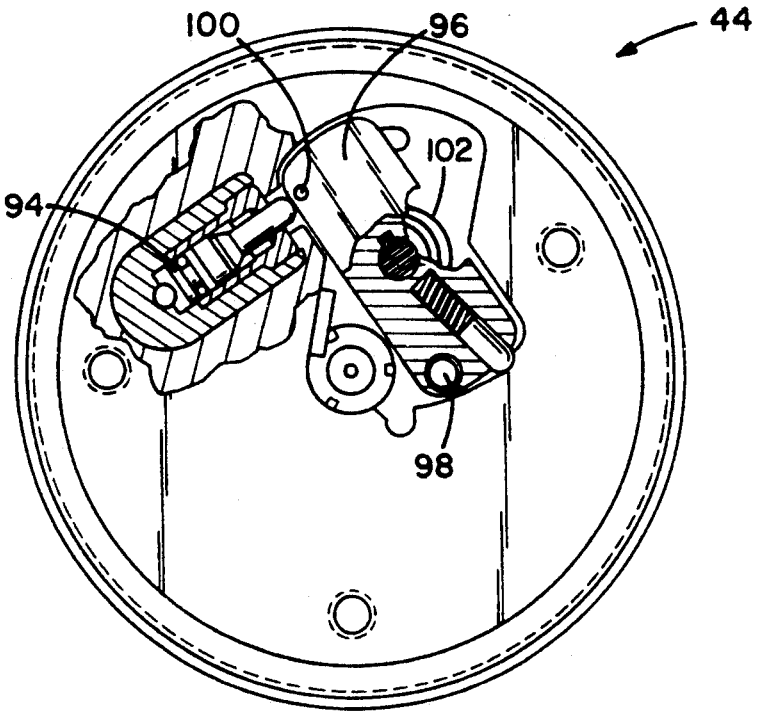
FIG. 6 is a sectional view of a preferred follow through charge arming assembly in the safe position.
Figure 7:
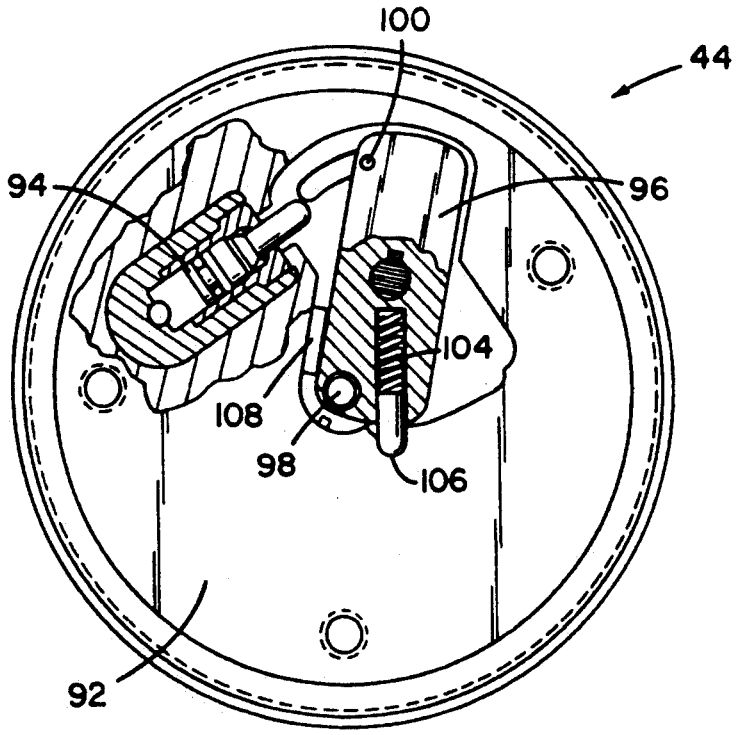
FIG. 7 is a sectional view of a preferred follow through charge arming assembly in the armed position.
Figure 9:
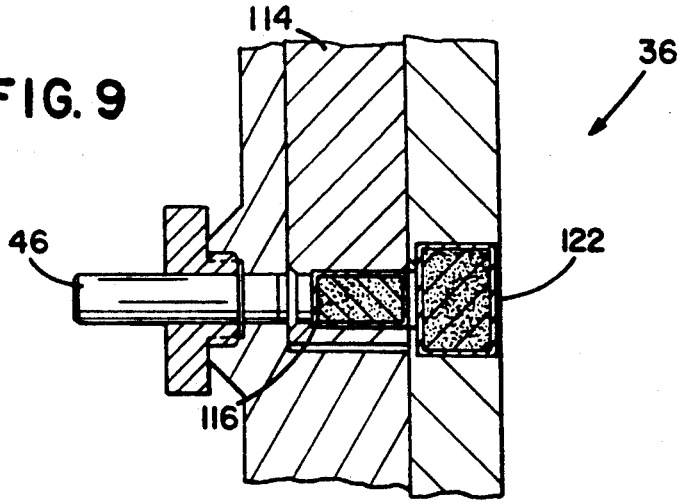
FIG. 9 is a sectional view of the primary explosives in alignment with the FTC firing pin in a preferred embodiment of the forward shaped charge arming assembly.

The arming assembly discussed below in connection with FIGS. 5, 6 and 7 are substantially similar for the Follow Through Charge as well as the Forward Shaped Charge. The primary differences arise in association with the firing pins, as illustrated in FIGS. 8 and 9, respectively.

Turning now to FIG. 5, the output interface charge 33 discussed above terminates in a space 90 in an FTC fuze housing 92. The space 90 is in communication with a piston 94 which is driven into a fuzing rotor 96 upon detonation of the output interface charge 33. The piston 94 of the present invention is constructed of steel, while the housing 92 is aluminum. This allows the piston 94 to deform the housing 92, locking the piston 94 in an extended position, shown in FIG. 7.

FIG. 6 is a top view of the FTC arming assembly 44 of the present invention in the safe condition. In the safe condition, the piston 94 rests against the fuzing rotor 96. The fuzing rotor 96 contains a delay primer explosive 98 (also referred to herein as the "first primary explosive") which is brought into alignment with a firing pin 110, illustrated in FIG. 8, when the piston 94 is extended. The delay primer 98 will be discussed in detail below.

A preferred FTC arming assembly 44 of the present invention contains a number of features to prevent the fuzing rotor 96 from accidentally moving into the armed condition. First, a shear pin 100 extends above the surface of the arming rotor 96 and engages with the fuze housing 92. Second, a bias spring 102 permanently biases the fuzing rotor 96 to the safe position, illustrated in FIG. 6.

FIG. 7 illustrates a preferred FTC arming assembly 44 of the present invention in the armed condition. At this point, the output interface charge 33, shown in FIGS. 4 and 5, has driven the piston 94 into the side of the fuzing rotor 96, breaking off the shear pin 100. The impact from the piston 94 has driven the fuzing rotor 96 in the clockwise condition so that a spring loaded locking pin 104 engages with a recess 106 in the fuze housing 92. A shock absorbing pad 108 is provided so that the fuzing rotor 96 does not bounce off the fuze housing 92 before the locking pin 104 can engage with the recess 106. Once engaged, the locking pin 104 prevents the rotor 96 from moving back to the safe position. As is illustrated in FIG. 8, the delay primer explosive 98 is now interposed between the FTC firing pin 110 and the follow through charge (not shown).

FIG. 8 is a side view of a preferred FTC fuzing assembly 44 illustrating the fuzing rotor 96 position so that the delay primer explosive 98 is in alignment with the FTC firing pin 110 and a follow through charge explosive train 124, discussed in detail below. A spring 112 is provided to prevent the FTC firing pin 110 from prematurely contacting the delay primer explosive 98. The FTC arming assembly 44 is now in the armed condition. The delay primer explosive 98 is then detonated by a sharp point 128 on the FTC firing pin 110.

A preferred FSC arming assembly 36 of the present invention is substantially similar to the FTC arming assembly 44 discussed above. The primary exception is that the FSC firing pin 46 on the FSC arming assembly 36 is not spring loaded. FIG. 9 illustrates the second primary explosive 116 in the fuzing rotor 114 in alignment with the FSC firing pin 46 (point not shown) and a FSC explosive train 120, indicative of the armed condition.

Figure 10:
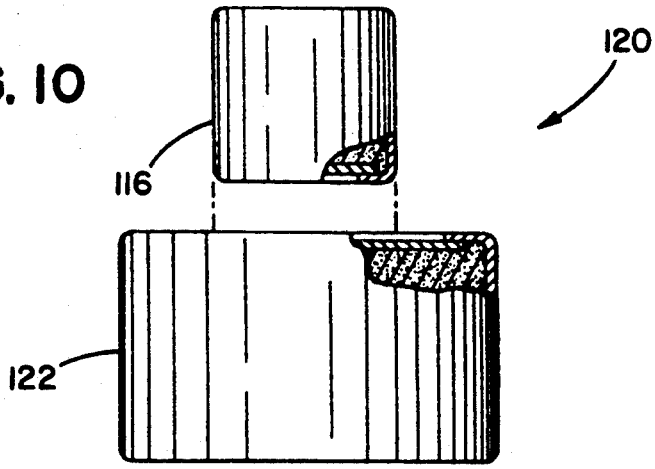
FIG. 10 illustrates a preferred forward shaped charge explosive train.

FIG. 10 illustrates a preferred FSC explosive train 120 of the present invention. The second primary explosive 116 contained in the rotor 114 may be an M55 stab primer detonator. Fifteen milligrams of NOL130, 62 milligrams of RD1333 lead azide, and 19 milligrams of RDX are known to be suitable for this purpose. A secondary or booster charge 122 then detonates the forward-shaped charge 24. Three hundred milligrams of PBXN-5 are known to be suitable as a booster charge 122.

Figure 11:
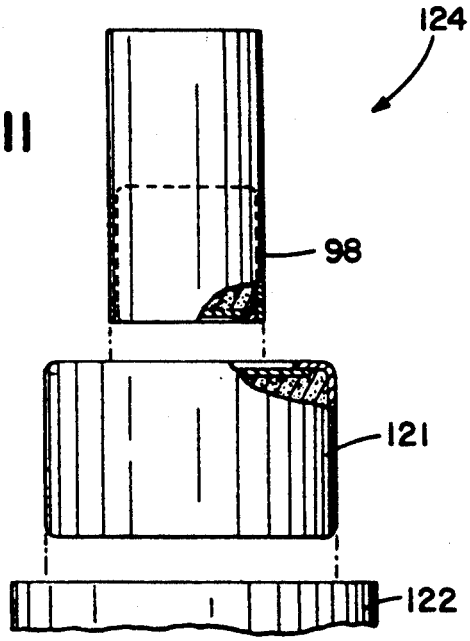
FIG. 11 illustrates a preferred follow through charge explosive train.

Detonation of the delay primer explosive 98 in the FTC charge arming assembly 44 triggers a different explosive train 124, which ultimately detonates the follow through charge 42. FIG. 11 illustrates one possible configuration of the explosive train 124 for the FTC arming assembly 44 of the present invention. NOL130 or RD1333 lead azide stab primers are suitable explosives for the delay primer explosive 98, as described in MIL-HDBK-777, which is hereby incorporated by reference. The delay primer explosive 98 may also be referred to as an Mk 420 fuze, which is available from the Hercules Powder Co., Port Ewen, New York. Detonation of the delay primer explosive 98 provides the delay that allows the follow through charge 42 to enter the opening created by the forward-shaped charge 24. The deflagration of the delay primer 98 detonates a M758 lead 121, which also operates as a booster, and a booster charges 122.

The method of the present invention requires the operator to mount the front surface 22 of the PAM 20 to the structure to be demolished. Firing devices such as blasting caps are then inserted into the blasting cap well 26. The operator performs two manual sequences to arm the fuzing system of the present invention. First, the spring loaded button 54 is depressed allowing the rotor 56 to be turned freely. Second, the rotor 56 is turned 90°, locating the explosives 60 contained in the modified lead cup 58 proximate to the blasting cap wells 26. At this point, the PAM 20 is armed for detonation.

Upon detonation of the blasting caps, the explosive 60 contained in the modified lead cup 58 activate the MDF input interface charge 32. The first MDF fuze explosive 38 ignites the propellant 40 and then detonates the MDF output interface charge 33, which drives the rotor 96 into the armed position. The second MDF fuze 34 likewise detonates the MDF output interface charge 33 which arms the rotor on the forward-shaped charge 24. The propellant 40 drives the follow through charge 42 into the FSC firing pin 46 on the rearward side of the forward-shaped charge 24. The detonation of the forward-shaped charge 24 creates an opening in the structure to be demolished. The blast wave from the forward-shaped charge 24 temporarily decelerates of the follow through charge 42, causing the FTC firing pin 110 to stab the delay primer explosive 98 contained in the rotor 96. The follow through charge firing train 124 is configured so that a delay is created, allowing the follow through charge 42 to enter the opening created by the forward-shaped charge 24. Upon entering the opening, the follow through charge 42 detonates, destroying the structure from the inside out.

It will be understood that the present invention is not limited to the examples discussed above, but may be changed or modified without departing from the spirit and scope of the present invention. For example, a variety of explosives can be used in the fuzing system. Further, the delay primer on the follow through charge may be replaced or augmented with an impact fuze on the nose of the follow through charge 42.

What is claimed is:

1. A fuzing system for use with tandem demolition warheads to sequentially activate a propellant on the rear of a follow through charge, detonate a forward shaped charge located between the follow through charge and the structure to be demolished and detonate the follow through charge after a brief delay comprising:

means for locating an interface charge proximate to a blasting cap in order to provide a pre-detonation state and for spatially separating said interface charge from the blasting cap providing a safe state;

first arming assembly means containing a first firing pin proximate to the follow through charge for providing a first armed state by interposing a first primary explosive between said first firing pin and the follow through charge;

second arming assembly means containing a second firing pin proximate to the forward shaped charge for providing a second armed state by interposing a second primary explosive between said second firing pin and the forward shaped charge;

first fuzing means responsive to said interface charge for igniting the propellant and for arming said first arming assembly means;

second fuzing means responsive to said interface charge for arming said second arming assembly means, causing the ignited propellant to accelerate the follow through charge into said second firing pin in order to detonate the forward shaped charge and form a hole in the structure to be demolished, and so that the detonation of the forward shaped charge decelerates the follow through charge and causes said first firing pin to impact said first primary explosive activating a fuzing delay means; and fuze delay means interposed between said first firing pin and the follow through charge, said fuzing delay means comprising means for providing sufficient delay in the detonation of the follow through charge to allow the follow through charge to enter the hole formed by the forward shaped charge before detonation.

2. The apparatus of claim 1 wherein said means for locating comprises:

rotor means containing said interface charge for spatially separating said interface charge from the blasting cap in said safe state and for positioning said interface charge proximate to the blasting cap in said pre-detonation state; and turning tab means for rotating said rotor means.

3. The apparatus of claim 2 wherein said means for locating further includes releasable locking means for retaining said rotor means in said safe state.

4. The apparatus of claim 2 wherein said means for locating further includes biasing means for retaining said rotor in said safe state.

5. The apparatus of claim 2 wherein said means for locating further includes releasable locking means for retaining said rotor in said armed state.

6. The apparatus of claim 1 wherein said first arming assembly means includes first fuzing rotor means containing said first primary explosive for spatially separating said first primary explosive from said first firing pin in said safe state and for positioning said first primary explosive proximate to said first firing pin in said armed state.

7. The apparatus of claim 6 wherein said first arming assembly means further includes first piston means responsive to said first fuzing means for extending said first piston means and for driving said first rotor means to said armed state.

8. The apparatus of claim 6 wherein said first arming assembly means further includes locking means for retaining said first fuzing rotor means in said armed state.

9. The apparatus of claim 6 wherein said first arming assembly means includes bias means for retaining said first fuzing rotor means in said safe state.

10. The apparatus of claim 6 wherein said first arming assembly means includes shear pin means comprising a shear pin for retaining said first fuzing rotor means in said safe state.

11. The apparatus of claim 1 wherein said second arming assembly means comprises second fuzing rotor means containing said second primary explosive for spatially separating said second primary explosive from said second firing pin in said safe state and for positioning said second primary explosive proximate to said second firing pin in said armed state.

12. The apparatus of claim 11 wherein said second arming assembly means further includes second piston means responsive to said second fuzing means for extending said second piston means and for driving said second rotor means to said armed state.

13. The apparatus of claim 11 wherein said second arming assembly means further includes locking means for retaining said second fuzing rotor means in said armed state.

14. The apparatus of claim 11 wherein said second arming assembly means further includes bias means for retaining said second fuzing rotor means in said safe state.

15. The apparatus of claim 11 wherein said second arming assembly means includes shear pin means comprising a shear pin for retaining said second fuzing rotor means in said safe state.

16. A fuzing method for use with tandem demolition warheads for sequentially activating a propellant on the rear of a follow through charge, detonating a forward shaped charge located between a follow through charge and a structure to be demolished and detonating the follow through charge after a brief delay comprising the steps of:

a) providing a first arming assembly means containing a first firing pin proximate to the follow through charge and means for interposing a first primary explosive between said first firing pin and the follow through charge;

b) providing a second arming assembly means containing a second firing pin proximate to the forward shaped charge and means for interposing a second primary explosive between said second firing pin and the forward shaped charge;

c) providing a fuze delay means interposed between said first firing pin and the follow through charge, d) locating an interface charge proximate to a blasting cap providing an armed state;

e) detonating the blasting cap to trigger said interface charge;

f) activating first and second fuzing means with said detonated interface charge, said activated first fuzing means igniting the propellant and causing said first primary explosive to be interposed between said first firing pin and the follow through charge, said activated second fuzing means causing said second primary explosive to be interposed between said second firing pin and the forward shaped charge;

g) propelling the follow through charge into said second firing pin, said second firing pin impacting said second primary explosive and detonating the forward shaped charge, the blast wave of the forward shaped charge decelerating said propelled follow through charge causing said first firing pin to impact said first primary explosive activating said fuzing delay means, said fuzing delay means providing sufficient delay in the detonation of the follow through charge to allow the follow through charge to enter the hole formed by the forward shaped charge before detonation.

17. The method of claim 16 wherein the step of locating said interface charge proximate to the blasting cap further comprising the steps of:

providing a rotor means containing said interface charge for spatially separating said interface charge from the blasting cap in a safe state and for positioning said interface charge proximate to the blasting cap in said armed state;

providing turning tab means for rotating said rotor means; and rotating said turning tab means to said armed state.

18. The method of claim 17 further including the step of providing a releasable locking means for retaining said rotor means in said safe state.

19. The method of claim 17 further including the step of providing a biasing means for retaining said rotor in said safe state.

20. The method of claim 17 further including the step of providing a releasable locking means for retaining said rotor in said armed state.

* * * * *

UNITED STATES PATENT AND TRADEMARK OFFICE

CERTIFICATE OF CORRECTION

PATENT NO. : 5,198,615

DATED : March 30, 1993

INVENTOR(S) : Robbie et al.

It is certified that error appears in the above-identified patent and that said Letters Patent is hereby corrected as shown below:

In the abstract, line 24, "foward" should read --forward--.

In column 1, line 5, after "support" insert --under Contract No. DAAA21.88-C-0151 awarded by the--.

In column 1, line 68, "con-figured" should read --configured--.

In column 2, line 47, delete "5".

Signed and Sealed this

First Day of March, 1994

*Attest:*

*Attesting Officer*

Bruce Lehman

BRUCE LEHMAN

*Commissioner of Patents and Trademarks*